US005958561A

United States Patent [19]

Held

[11] Patent Number: 5,958,561

[45] Date of Patent: Sep. 28, 1999

[54] INK/TEXTILE COMBINATION HAVING IMPROVED PROPERTIES

[75] Inventor: Robert Paul Held, Newark, Del.

[73] Assignee: E. I. du Pont de Nemours and Company, Wilmington, Del.

[21] Appl. No.: 09/001,871

[22] Filed: Dec. 31, 1997

[51] Int. Cl.[6] ..... B32B 5/16; B05D 5/00

[52] U.S. Cl. ..... 428/207; 427/288; 427/394; 427/412; 428/476.1; 428/477.7; 428/483; 428/500; 428/507; 428/913.3

[58] Field of Search ..... 8/541; 427/288, 427/394, 412; 428/207, 476.1, 477.7, 483, 500, 507, 913, 913.3

[56] References Cited

U.S. PATENT DOCUMENTS 4,732,786 3/1988 Patterson et al. ..... 427/288 X
5,085,698 2/1992 Ma et al. ..... 106/20
5,272,201 12/1993 Ma et al. ..... 524/505
5,510,415 4/1996 Zahrobsky et al. ..... 524/506
5,851,590 12/1998 Donovan et al. ..... 427/288 X
5,853,861 12/1998 Held ..... 428/207

*Primary Examiner*—Janyce Bell
*Attorney, Agent, or Firm*—Joseph A. Tessari

[57] ABSTRACT

A durable image is formed by the combination of an aqueous ink comprising an aqueous vehicle and a colorant; and a textile, wherein said textile has been treated with a hydrophilic composition containing at least one crosslinkable thermoplastic polymer, said crosslinkable polymer having a number average molecular weight of at least 6,000 and being selected from the group consisting of polymers having at least one carboxylic acid group and at least one crosslinkable group; and a mixture of at least two polymers wherein at least one has a carboxylic acid group and at least one other has a crosslinkable group.

11 Claims, No Drawings

INK/TEXTILE COMBINATION HAVING IMPROVED PROPERTIES

BACKGROUND OF THE INVENTION

This invention relates to a process for providing printed images on textile using ink-jet printing, and more particularly, to a process for providing printed images on textile having excellent wet fastness properties and improved color bleed.

Anionic dyes such as acid dyes and pre-metallized dyes are widely used for the dyeing of polyamide fibers in which the nitrogen containing groups of the polyamide fibers such as nylon and hydroxy groups of the cellulose fibers such as cotton, rayon etc. serve as the dye sites.

Conventionally, the dyeing of fiber containing articles involves immersion of the article in an aqueous bath containing a solution of the dye after the article has been pretreated by treatments well-known in the art. Typically all the dye used in the process is added to the bath prior to immersion of the article; that is, the bath is at "full strength" prior to immersion of the article. The bath is then typically raised to an elevated temperature, often as high as the boiling point at ordinary atmospheric pressure. At times, dyeing is done at extreme temperatures using autoclaves.

In an alternate process, disclosed in U.S. Pat. No. 5,230,709, the bath containing the article is first raised to a temperature characterized as a "transition temperature" for the particular polyamide. The dye solution is then introduced to the bath in aliquots in such a way that the polyamide fibers are kept "hungry" for dye.

The above processes are used for uniform dyeing of the article. For dyeing articles to produce a pattern, it is known to use a screen printing process for the application of the dye.

Dyes which are used in the processes known in the art are often called small molecule "leveling" dyes. Where good light fastness and/or wash fastness are required, large molecule and pre-metallized dyes are more desirable. Yet, these types of dyes have the disadvantage in that they are structure sensitive, meaning that minor variation in the physical structure of the fibers are revealed in the final dyed product. This is undesirable. It is known to use dye auxiliaries and retarding agents to counteract this defect, but the use of such compounds often inhibit the ability of the fibers to be deeply colored or have dark shades.

Another approach to dyeing polyamides and mixed fiber articles, such as polyamides and cotton, makes use of fiber reactive dyes. Such reactive dyes form covalent bonds with free amine end groups of the polyamide fraction and covalent bonds with the hydroxyl groups of the cellulosic fraction. One class of reactive dyes are the dichloro-s-triazinyl system. These dyes in aqueous solution can be displaced from solution onto the polyamide by addition of salt (e.g., potassium chloride) and then alkali which fixes the dye with the fiber. Another class are the vinyl sulfone reactive dyes based upon sulfate esters of hydroxysulphonyl dyes. Under alkaline conditions the vinyl sulfone group is generated which in turn reacts with ionized cellulose to form the covalent bond between dye and fiber. As disclosed in U.S. Pat. No. 4,762,524; dyeing of polyamides at the boil with vinyl sulfone reactive dyes is also possible under conditions therein disclosed. As a result, it is known to dye polyamide and cotton blends with appropriately chosen fiber reactive dye systems. In particular, better wash fastness and color fastness for deep shades are obtainable with fiber reactive dyes. However, this process is disadvantageous in that it includes wet processing and the proper disposal of the effluent stream containing unreacted dye adds expense and raises environmental concerns.

Attempts have been made recently to reproduce high quality colored pictorial information using ink jet technologies for applications such as textile printing. Ink jet printing is a non-impact method for recording information in response to an electronic signal, such as that generated by a computer. In the printer, the electronic signal produces droplets of ink that are deposited on a substrate or media such as paper or transparent film. Such attempts have been met with several challenges. For example, it has proved difficult to accurately reproducing the various hues, tints, and colors contained in a typical colored picture on textile articles using ink jet printers. In addition, the images printed on such articles are expected to have good wet fastness properties which include durability (wet and dry crock-fastness), water-fastness and wash-fastness.

The processes described above for processing of textiles have several processing limitations and the dyes have their own limitations when it is desired to record a high quality, multicolored image. Color selection is limited because many of the readily available dyes lack color fastness (i.e., the dye tends to fade upon exposure to ultraviolet light) or do not have enough solubility to give the required chroma. Moreover, the tendency of ink droplets to wick or bleed together is an aggravated problem because the printing of a high quality image depends on the formation of small, sharply defined dots of each printed color. While some of the problems associated with dye based inks can be overcome or alleviated to some extent, a need still exists for better inks and/or better treatments or coatings for textiles that will be ink jet printed. A specific need exists for a textile treatment which provides an ink jet printed textile having a high quality, durable, wash-fast and water-fast image without bleed problems, thereby meeting the requirements for textile printing.

SUMMARY OF THE INVENTION

The present invention provides an ink jet ink/textile combination comprising:

a) an aqueous ink comprising an aqueous vehicle and colorant; and b) a textile, wherein said textile has been treated with a hydrophilic composition containing at least one crosslinkable thermoplastic polymer, said crosslinkable polymer having a molecular weight of at least 6,000 and being selected from the group consisting of 1) polymers having at least one carboxylic acid group and at least one crosslinkable group; and 2) a mixture of at least two polymers wherein a first polymer has at least one carboxylic acid group and a second polymer has at least one crosslinkable group.

In another aspect, the invention also provides a process for forming a durable printed image on textile comprising the steps of, in sequence:

a) providing a textile, wherein said textile has been treated with a hydrophilic composition containing at least one crosslinkable thermoplastic polymer, said crosslinkable polymer having a molecular weight of at least 6,000 and being selected from the group consisting of 1) polymers having at least one carboxylic acid group and at least one crosslinkable group; and 2) a mixture of at least two polymers wherein a first polymer has at least one carboxylic acid group and a second polymer has at least one crosslinkable group;

b) printing an aqueous ink image on the textile; and c) heating the printed image to a temperature in the range of approximately 100 to 190° C. for about 5 seconds to 30 minutes to sequentially (1) soften said hydrophilic thermoplastic polymer and encapsulate the ink colorant, and (2) cross-link said polymer to form a hydrophobic matrix.

The hydrophilic thermoplastic composition may be in the form of a solution or a dispersion and may contain a single thermoplastic polymer having both the carboxylic acid group(s) and crosslinkable group(s), or may constitute a mixture of polymers wherein these groups are present as constituents of different polymers. The invention may be practiced with inks containing pigment or dye colorants. In preferred embodiments, the textile treatment also contains a neutralizing component that inhibits cracking of the cured coating.

The process has general utility in textile printing applications, and has special utility in demanding ink-jet textile printing applications involving printing of textiles with pictorial information in addition to text.

DETAILED DESCRIPTION OF THE INVENTION

Textiles suitable for use in this invention are those that have been treated with a hydrophilic thermoplastic polymer composition (solution or dispersion) comprising a crosslinkable thermoplastic polymer (or mixture of polymers) having a molecular weight of at least 6,000. The thermoplastic polymer may be one polymer, which has at least one carboxylic acid group and at least one crosslinkable group, or a mixture of compatible polymers that individually have the carboxylic acid group(s) and crosslinkable group(s). As used herein, the term "hydrophilic" means that an aqueous ink vehicle, which may contain organic components such as penetrants, will be absorbed into the thermoplastic polymeric solution or dispersion, and the term "compatible" means that the mixture of polymers is such that an image printed on the treated textile will not exhibit undue light-scattering that would detract from image quality. The mixture may either be a single phase, or a fine dispersion.

The thermoplastic polymeric composition is initially hydrophilic, so that it readily absorbs the aqueous ink vehicle during the printing step. After printing, the thermoplastic hydrophilic polymer softens upon heating at a temperature in the range of 100 to 190° C., and encapsulates the ink colorant. Then, the polymer cross-links to form a durable hydrophobic matrix. Typically, the encapsulation and cross-linking will occur between 5 seconds and 30 minutes.

The hydrophilic property is provided by the presence of carboxylic acid groups on the selected thermoplastic polymer. The cross-linking property is provided by presence of a cross-linking group, typically hydroxyl, epoxy, amine, isocyanate, amide, and/or acrylamide group(s). To form a useful treatment solution or dispersion, the thermoplastic polymer, or mixture thereof, will have a molecular weight of at least 6,000, and preferably at least 10,000. Representative single polymers, which bear both the carboxylic acid and cross-linking groups, include interpolymers formed from 40% N-tert-octyl acrylamide/34% methyl methacrylate/16% acrylic acid/6% hydroxypropyl methacrylate/4% t-butyl amino ethyl methacrylate and having a molecular weight of approximately 50,000.

If a mixture of polymers is used in the composition, one of the polymers would provide the acid groups (the "Acid Polymer") and would be a hydrophilic, thermoplastic copolymer prepared from (1) acrylic acid, methacrylic acid, an olefinic dicarboxylic acid (e.g., maleic or itaconic acid), or an olefinic dicarboxylic anhydride (e.g., maleic or itaconic anhydride) copolymerized with (2) a lower alkyl (i.e., 1 to 6 carbon atoms) acrylate or methacrylate ester, dialkylamino acrylate or methacrylate, styrene, vinyl acetate, vinyl ethyl or methyl ether, vinyl pyrrolidone, ethylene oxide, or the like. Representative copolymers that may be selected to advantage include methacrylate (37%)/ethyl acrylate (56%)/acrylic acid (7%) terpolymer, acid no. 76–85, molecular weight 260,000; methyl methacrylate (61.75%)/ethyl acrylate (25.75%)/acrylic acid (12.5%) terpolymer, acid no. 100, molecular weight 200,000; styrene/maleic anhydride half ester copolymers, with styrene to maleic anhydride ratios of 1.4/1 to 1.0/1 and molecular weights from 60,000 to 215,000; poly(methyl vinyl ether/maleic acid); etc. An acrylic polymer containing alkylaminoethylmethacrylate, such as a copolymer of butyl methacrylate/dimethylaminoethyl methacrylate, (80/20), average molecular weight 11,000, also may be selected. Useful copolymers are readily prepared using conventional polymerization techniques such as solution polymerization, emulsion polymerization, etc.

The other polymer in the mixture would supply the crosslinking groups (the "Crosslink Polymer"). Representative compounds that may be selected for this purpose include polyvinyl alcohol, cellulose compounds such as polyhydroxyethyl cellulose and polyhydroxymethyl cellulose, melamine-formaldehyde resins, epoxy resins, polyamides, polyamines, polyisocyanates, polyacrylamides, and polyvinyl pyrrolidone.

The amount of Crosslink Polymer is not critical, so long as enough is present to effectively crosslink the Acid Polymer during the post-printing heat treatment, after the Acid Polymer has at least partially encapsulated the ink colorant. The weight ratio of Acid Polymer to Crosslink Polymer generally will be in the range of 20/80 to 80/20, preferably 30/70 to 70/30. A weight ratio of 50/50 generally will provide the desired results.

In a preferred embodiment, the thermoplastic composition also will contain a neutralizing component to minimize or avoid cracking of the cured coating. Volatile compounds (e.g., ammonia; N,N-dimethylethanolamine; triethanol amine; 2-amino-2-methyl propanol) providing 20 to 100%, preferably 40 to 100%, neutralization may be selected to adjust pH of the thermoplastic composition above 4.0, which has been found to be advantageous. Generally, presence of 2 to 8% neutralizing component in the composition will be effective for this purpose.

The thermoplastic composition also may contain an inorganic filler, such as silica or silicates, zeolites, calcined kaolins, diatomaceous earth, barium sulfate, aluminum hydroxide, or calcium carbonate. The ratio of filler to polymer will vary with the particular components. Surfactants, plasticizers, humectants, UV absorbers, polymeric dispersants, defoamers, mold inhibitors, antioxidants, latex, dye mordants, optical brighteners, penetrants, oils, flame retardants, anti pill agents, carriers (solvents for swelling the textile), softeners, and other additives may be included for conventional purposes.

Generally the thermoplastic polymer(s) will comprise 60 to 100%, preferably 80 to 100%, by weight of the total thermoplastic composition.

Textile Preparation

The thermoplastic composition is generally applied to the textile in a dry weight range of 0.5 g/M$^2$ to about 20 g/M$^2$. Appropriate application weight is needed to provide sufficient absorbing capacity to prevent ink spread and/or puddling. Low coverage images may only require an application of 0.5 g/$M^2$ to 10 g/$M^2$ whereas high coverage images may require an application of 8 g/$M^2$ to 20 g/$M^2$. The composition may be applied to the textile using conventional padders used to apply solution to textiles.

Application

The treated textile is particularly adapted for use with commercial aqueous ink-jet inks employing a particulate colorant (i.e., a pigment or a dispersed dye), but also may be used with inks having a soluble dye colorant. The pigmented inks generally will contain a polymeric dispersant, such as the block copolymer dispersants described in U.S. Pat. No. 5,085,698 and in EP 0556649A1, or a random or graft polymeric dispersant. Various additives and cosolvents generally are also present, as described in U.S. Pat. No. 5,272,201, to improve ink drying time and other conventional purposes.

Ink is applied to the treated textile using conventional ink jet printing equipment, such as thermal or bubble jet printers, piezoelectric printers, continuous flow printers, or valve jet printers. Then, the treated textile is cured for 5 seconds to 30 minutes at a temperature in the range of 100 to 190° C., with shorter times being required at the higher temperatures. The desired results generally are achieved by heating to 140 to 180° C. for 30 seconds to 5 minutes. An oven or radiant heater may be used for this purpose. During curing, the thermoplastic polymer present in the treated textile softens and at least partially encapsulates the ink colorant, and then crosslinks to form a hydrophobic matrix. The resulting printed image has improved wet fastness properties and exhibits improved bleed characteristics. The process is particularly useful for the printing of pictorial information, as well as text and graphic information, in textile printing applications.

EXAMPLES

Polymer 1

Benzyl methacrylate-b-methacrylic acid (13//10) block copolymer. A 12-liter flask was equipped with a mechanical stirrer, thermometer, N2 inlet, drying tube outlet, and addition funnels. Tetrahydrofuran THF, 3750 gm, and p-xylene, 7.4 gm, were charged to the flask. The catalyst tetrabutyl ammonium m-chlorobenzoate, 3.0 ml of a 1.0 M solution in acetonitrile, was then added. Initiator, 1,1-bis (trimethylsiloxy)-2-methyl propene, 291.1 gm (1.25 M) was injected. Feed I [tetrabutyl ammonium m-chlorobenzoate, 3.0 ml of a 1.0 M solution in acetonitrile] was started and added over 180 minutes. Feed II [trimethylsilyl methacrylate, 1975 gm (12.5 M)] was started at 0.0 minutes and added over 35 minutes. One hundred minutes after Feed II was completed (over 99% of the monomers had reacted) Feed III [benzyl methacrylate, 2860 gm (16.3 M) was started and added over 30 minutes. At 400 minutes, 720 gm of methanol were added to the above solution and distillation begun. During the first stage of distillation, 1764.0 gm of material were removed. Then more methanol 304.0 gm was added and an additional 2255.0 gm of material were distilled out. This produced a block copolymer (Mn=2966) solution at 49.7% solids.

Polymer 2

Butyl methacrylate-co-methyl methacrylate-b-methacrylic acid (10/5//10) block copolymer. A 12-liter flask was equipped with a stirrer, thermometer, N2 inlet, drying tube outlet and addition funnels. Tetrahydrofuran ("THF"), 3027 g, and p-xylene, 6.2 g were charged to the flask. The catalyst, tetrabutyl ammonium m-chlorobenzoate, 2.5 ml of a 1.0 M solution in acetonitrile, was then added. The initiator, 1,1-bis(trimethylsiloxy)-2-methylpropene, 234.4 g, was injected. Feed I (tetrabutyl ammonium m-chlorobenzoate, 2.5 ml of a 1.0 M solution in acetonitrile) was started and added over 150 minutes. Feed II (trimethylsilyl methacrylate, 1580 g) was started at 0.0 min and added over 30 minutes. One hundred and twenty minutes after Feed II was completed, Feed III (butyl methacrylate, 1425 g and methyl methacrylate, 503 g) was started and added over 30 minutes. At 320 minutes, 650 g of dry methanol were added to the above solution and distillation was started. During the first stage of distillation 1250.0 g of material were removed from the flask. Isopropanol, 1182 g, was added. Distillation continued and a total of 2792 g of solvent were removed. The resulting polymer had a Mn=2780.

Black Pigment Concentrate

A black pigment concentrate was prepared by mixing together 100 grams of Polymer 2; 200 grams of FW-18 pigment (Degussa Corp., Allendale, N.J.) and 200 grams of diethylene glycol. The premixture was then charged to a Model XJF-S2637 two roll mill (Adalet Manufacturing Co., Cleveland Ohio) and processed for 45 minutes. The temperature of one roll was held at 150° C. and the other roll was approximately 10° C. cooler. This made a pigment chip that contained 50% pigment, 25% polymer (P/D ratio=2/1) and 25% diethylene glycol. An aqueous pigment concentrate using 2-dimethylaminoethanol as the neutralizing agent was then prepared by mixing 1200 grams of the pigment chip with 96.2 grams of 2-dimethylaminoethanol and 2704 grams of deionized water with stirring. The resulting pigment concentrate contained 15% pigment.

Yellow Pigment Concentrate

A yellow pigment concentrate was prepared by mixing together 305.4 grams of Polymer 1; 183.3 grams of Y-128 pigment (Diazo Yellow 8GN from Ciba) and 64 grams of diethylene glycol. The premixture was then charged to a two roll mill as above. This made a pigment chip that contained 45.82% pigment, 38.18% polymer (P/D ratio=1.2/1) and 16% diethylene glycol. An aqueous pigment concentrate using 2-dimethylamino-ethanol as the neutralizing agent was then prepared by mixing 1809.9 grams of the pigment chip with 217 grams of 2-dimethylaminoethanol and 1973.1 grams of deionized water with stirring. The resulting pigment concentrate contained 15% pigment.

Magenta Pigment Concentrate

A magenta pigment concentrate was prepared by mixing together 272 grams of Polymer 1; 204 grams of PR-122 pigment (Quindo Magenta 122, BASF) and 66 grams of diethylene glycol. The premixture was then charged to a two roll mill and processed as above. The pigment chip contained 51% pigment, 34% polymer (P/D ratio=1.5/1) and 15% diethylene glycol. An aqueous pigment concentrate was then prepared by mixing 1809.9 grams of the pigment chip with 217 grams of 2-dimethylaminoethanol and 1973.1 grams of deionized water with stirring. The resulting pigment concentrate contained 15% pigment.

Cyan Pigment Concentrate

A cyan pigment concentrate was prepared by mixing together 144 grams of Polymer 1; 216 grams of PB 15:3 pigment (Endurophthal Blue GF BT-617-D) and 40 grams of diethylene glycol. The premixture was then charged to a two roll and processed to produce a chip that contained 54% pigment, 36% polymer (P/D ratio=1.5/1) and 10% diethylene glycol. An aqueous pigment concentrate was then prepared by mixing 1809.9 grams of pigment chip with 217 grams of 2-dimethylaminoethanol and 1973.1 grams of deionized water with stirring. The resulting pigment concentrate contained 15% pigment.

Ink formulations

A series of inks were prepared having the following compositions:

| Ingredient | Amount (weight %) | | | |
|---|---|---|---|---|
| | cyan | yellow | magenta | black |
| Cyan Pigment Concentrate | 13.3 | | | |
| Yellow Pigment Concentrate | | 23.3 | | |
| Magenta Pigment Concentrate | | | 23.3 | |
| Black Pigment Concentrate | | | | 30.0 |
| Diethylene glycol | 4.5 | 6.0 | 4.5 | 5.7 |
| Liponics ® EG-1 | 5.0 | 6.0 | 5.0 | 5.7 |
| Zonyl ® FSO-100 | 0.05 | | 0.05 | |
| Surfynol ® 440 | | 0.2 | | 0.2 |
| Deionized water to make 100% | | | | |

Thermoplastic Compositions

A series of thermoplastic compositions were prepared as follows:

| Ingredient | Amount (g) | | | | | | | |
|---|---|---|---|---|---|---|---|---|
| | A | B | C[8] | D[8] | E | F | G | H |
| Evanol ® 52-22[1] | 100 | 50 | 50 | 50 | | 50 | 20 | 50 |
| Evanol ® T-25[1] | | | | | 50 | | | |
| SMA[2] | 100 | 25 | | | | | | |
| SMA[3] | | | | | | | 20 | 25 |
| PVP[4] | | 5.5 | | 5.5 | 5.5 | 5.5 | | |
| PVP[5] | | | | | | | | 25 |
| Gantrez ® S95[6,7] | | | | | 25 | | | |
| Gantrez ® S97BF[6] | | | | | | 25 | | |
| deionized water | 70 | 100 | 60 | 80 | 150 | 375 | 20 | 110 |

Notes:
[1]10% polyvinyl alcohol solution in water; E. I. du Pont de Nemours & Co.
[2]10% styrene/maleic anhydride copolymer solution in water, product #30627-4; Aldrich Chemical Co.
[3]10% sytrene/maleic anhydride copolymer solution in water, product #20063-8; Aldrich Chemical Co.
[4]45% polyvinyl pyrrolidone solution in water, grade K60
[5]45% polyvinyl pyrrolidone solution in water, grade K120
[6]10% vinylmethylether/maleic anhydride copolymer solution in water; ISP Technologies, Inc.
[7]A small amount of $NH_3$ added to dissolve.
[8]Control Test Methods The textiles used were cotton T-shirt material (Style 437W) and polyester (Style 730), both from TestFabrics, Inc. Samples of material were treated using the #5 wire rod and were then air dried. Samples we spray adhesive in order to aid transport through the Encad Novajet printer and were printed with the inks. After printing, the samples were heated in a convection oven for 5 minutes at 180° C. The samples were then cut in half, with half being washed for 5 wash cycles using standard powder detergent in a standard washing machine. Color measurements were made on both the washed and unwashed halves using a Colortron® Color system made by Light Source, San Rafael, Calif. The average color difference (Delta E) for washed vs. unwashed sample for all colors (i.e., black, yellow, cyan, magenta, red, green and blue) is show in Table 1 below.

TABLE 1

| Textile | Treating Solution | Delta E |
|---|---|---|
| cotton | none | 29.2 |
| | A | 3.9 |
| | B | 7.3 |
| polyester | none | 21.9 |
| | C (control) | 26.9 |
| | D (control) | 26.6 |
| | E | 12.9 |
| | F | 8.3 |
| polyester | none | 20.7 |
| | G | 5.3 |
| | H | 9.2 |

The results on cotton show that treating the textile in accordance with the invention reduced the loss of the pigment color during the washing process. The results on polyester show that the maleic anhydride polymers having crosslinking capability with polyvinyl alcohol are needed for achieving washfastness and demonstrate the effectiveness of textile treatment in providing washfastness to the polyester textile.

What is claimed is:

1. An ink jet ink/textile combination comprising:

a) an aqueous ink comprising an aqueous vehicle and a colorant; and b) a textile, wherein said textile has been treated with a hydrophilic composition containing at least one crosslinkable thermoplastic polymer, said crosslinkable polymer having a number average molecular weight of at least 6,000 and being selected from the group consisting of 1) polymers having at least one carboxylic acid group and at least one crosslinkable group; and 2) a mixture of at least two polymers wherein a first polymer has at least carboxylic acid group and a second polymer has at least one crosslinkable groups wherein said ink is printed on said textile to form an image.

2. The ink jet ink/textile combination of claim 1 wherein said thermoplastic composition comprises a single thermoplastic polymer having at least one carboxylic acid group and at least one crosslinkable group and wherein the crosslinkable group is selected from the group consisting of hydroxyl, epoxy, amine, isocyanate, amide, and acrylamide groups.

3. The ink jet ink/textile combination of claim 1 wherein said thermoplastic composition comprises a mixture of (A) a hydrophilic thermoplastic copolymer prepared from (1) acrylic acid, methacrylic acid, an olefinic dicarboxylic acid, or an olefinic dicarboxylic anhydride, and (2) a lower alkyl acrylate or methacrylate ester, dialkylamino acrylate or methacrylate, styrene, vinyl acetate, vinyl ethyl or methyl ether, vinyl pyrrolidone, or ethylene oxide; and (B) a polymer having crosslinking groups.

4. The ink jet ink/textile combination of claim 3 wherein the polymer having crosslinking groups is selected from the group consisting of polyvinyl alcohol, a cellulose compound, a melamine-formaldehyde resin, an epoxy resin, a polyamide, a polyamine, a polyisocyanate, a polyacrylamide, or polyvinyl pyrrolidone.

5. The ink jet ink/textile combination of claim 4 wherein the weight ratio of A to B is in the range of 20/80 to 80/20.

6. The ink jet ink/textile combination of claim 1 wherein said colorant is a pigment and wherein said ink further contains a polymeric dispersant.

7. A process for forming a durable printed image on a textile comprising, in sequence:

a) providing a textile, wherein said textile has been treated with a hydrophilic composition containing at least one crosslinkable thermoplastic polymer, said crosslinkable polymer having a molecular weight of at least 6,000 and being selected from the group consisting of
   1) polymers having both carboxylic acid groups and a crosslinkable group and
   2) a mixture of at least two polymers wherein at least one has a carboxylic acid group and another has a crosslinkable group;

b) printing an aqueous ink image on a textile; and c) heating the printed image to a temperature in the range of approximately 100 to 190° C. for about 5 seconds to 30 minutes to sequentially (1) soften said hydrophilic thermoplastic polymer and encapsulate the ink colorant, and (2) cross-link said polymer to form a hydrophobic matrix.

8. The process of claim 7 wherein said thermoplastic composition comprises a single thermoplastic polymer having at least one carboxylic acid group and at least one crosslinkable group and wherein the crosslinkable group is selected from the group consisting of hydroxyl, epoxy, amine, isocyanate, amide, and acrylamide groups.

9. The process of claim 7 wherein step (c) comprises heating the image to a temperature of 140 to 180° C.

10. The process of claim 7 wherein step (c) comprises heating the image for a period of 30 seconds to 5 minutes.

11. The process of claim 7 wherein said colorant comprises a pigment and wherein the ink further contains a polymeric dispersant.

* * * * *